US007612791B2

(12) United States Patent
Sugimoto

(10) Patent No.: US 7,612,791 B2
(45) Date of Patent: Nov. 3, 2009

(54) PRINTER INCLUDING WIRELESS COMMUNICATION MODULE

(75) Inventor: Tasuku Sugimoto, Nagoya (JP)

(73) Assignee: Brother Kogyo Kabushiki Kaisha, Nagoya-shi, Aichi,ken (JP)

( * ) Notice: Subject to any disclaimer, the term of this patent is extended or adjusted under 35 U.S.C. 154(b) by 288 days.

(21) Appl. No.: 11/484,613

(22) Filed: Jul. 12, 2006

(65) Prior Publication Data

US 2007/0014620 A1 Jan. 18, 2007

(30) Foreign Application Priority Data

Jul. 12, 2005 (JP) ..... 2005-203132

(51) Int. Cl.
*B41J 2/435* (2006.01)

(52) U.S. Cl. ..... 347/263

(58) Field of Classification Search ..... None
See application file for complete search history.

(56) References Cited

U.S. PATENT DOCUMENTS

| | | | | |
|---|---|---|---|---|
| 6,509,877 | B2 | 1/2003 | Masaki | |
| 6,625,013 | B2 | 9/2003 | Minaguchi et al. | |
| 2003/0198014 | A1 | 10/2003 | Murayama | |
| 2005/0062836 | A1 * | 3/2005 | Nakajima | 347/225 |
| 2005/0128237 | A1 * | 6/2005 | Otsuki | 347/19 |
| 2006/0067738 | A1 * | 3/2006 | Ohara et al. | 399/227 |

FOREIGN PATENT DOCUMENTS

| | | |
|---|---|---|
| JP | 2002-073210 | 3/2002 |
| JP | 2002-207535 | 7/2002 |
| JP | 2002-217754 | 8/2002 |
| JP | 2003-318556 | 11/2003 |
| JP | 2004-062245 | 2/2004 |

* cited by examiner

*Primary Examiner*—Matthew Luu
*Assistant Examiner*—Justin Seo
(74) *Attorney, Agent, or Firm*—Banner & Witcoff, Ltd.

(57) ABSTRACT

A printer includes: a main substrate that includes electronic parts for controlling an operation of a printer main body; and a wireless communication module that transmits and receives data, wherein: the main substrate is disposed in one side of the printer main body; and the wireless communication module is disposed in another side of the printer main body.

9 Claims, 10 Drawing Sheets

PRINTER INCLUDING WIRELESS COMMUNICATION MODULE

CROSS-REFERENCE TO THE RELATED APPLICATION(S)

This application is based upon and claims a priority from prior Japanese Patent Application No. 2005-203132 filed on Jul. 12, 2005, the entire contents of which are incorporated herein by reference.

TECHNICAL FIELD

Aspects of the present invention relate to a printer wherein a wireless communication module is built into a printer main body.

BACKGROUND

Various types of network connection interfaces have been developed. For example, when a printer and a network are connected, a parallel interface can be used for directly connecting the printer and a personal computer. Further, a wireless LAN can perform a printing operation by connecting a wireless LAN printer server to a personal computer.

In JP-A-2004-62245, a wireless LAN printer server, which includes a LAN port and a parallel port or serial port, is connected to the printer. Data is transmitted or received via an Ethernet (R) port functioning as a signal line. Power is supplied from a connection apparatus to an accessory via the parallel port or serial port functioning as a power line.

However, since a wireless LAN printer server is developed after development of a printer, it is necessary to connect the wireless LAN printer server to the conventional printer. Therefore, in many cases, a wireless LAN printer server becomes a separate option attached to an outside of a printer. In the wireless LAN printer server, power is supplied from a designated adaptor, and printing data is transmitted or received via a parallel interface (a parallel port).

SUMMARY

When the printer to which the above-mentioned kind of wireless LAN printer server is connected, an AC adaptor for the wireless LAN printer server is needed. Accordingly, the amount of wiring on a periphery of the printer is increased.

Further, in JP-A-2004-62245, it is necessary to connect the wireless LAN printer server to the printer.

Aspects of the present invention provide a printer including a wireless communication module. Accordingly, the connection operation becomes unnecessary, and a communication with other instruments is improved.

According to an aspect of the invention, there is provided a printer including: a main substrate that includes electronic parts for controlling an operation of a printer main body; and a wireless communication module that transmits and receives data, wherein: the main substrate is disposed in one side of the printer main body; and the wireless communication module is disposed in the other side of the printer main body.

According to the aspect, since the wireless communication module is built into the printer main body, a connecting of a wireless communication apparatus and a printer is eliminated. Accordingly, the printer can be used easily. Further, according to the aspect, the main substrate is disposed in one side surface of the printer main body. The wireless communication module is disposed in the other side surface of the printer main body. Thus, the wireless communication module is separated from the main substrate. Accordingly, the main substrate does not become an obstacle to the communication. And, a good communication is maintained.

According to another aspect of the invention, there is provided a printer including: a left frame and a right frame that support an internal mechanism and are formed of a synthetic resin; a casing that covers the left and right frames and is formed of a synthetic resin; a main substrate that includes electronic parts for controlling an operation of the printer; and a wireless communication module that transmits and receives data, wherein: the main substrate is disposed on an external surface of one of the left and right frames; the wireless communication module is disposed on an external surface of the other of the left and right frames; and the main substrate and the wireless communication module are covered by the casing.

According to another aspect of the invention, there is provided a printer including: a left frame and a right frame that support an internal mechanism and are formed of a synthetic resin; a casing that covers the left and right frames and is formed of a synthetic resin; a main substrate that includes electronic parts for controlling an operation of the printer; and a wireless communication module that transmits and receives data, wherein: the main substrate is disposed on an external surface of the left frame; the wireless communication module is disposed on an external surface, an upper and a front side of the right frame; and the main substrate and the wireless communication module are covered by the casing.

According to the aspects, a main substrate is disposed on an external surface of one of the synthetic resin left and right frames, and a wireless communication module is disposed on an external surface of the other of the synthetic resin left and right frames. Therefore, the wireless communication module is separated from the main substrate. Thus, the main substrate does not become an obstacle to the communication. Accordingly, a good communication is maintained. Further, according to the aspects, since the main substrate and the wireless communication module are covered by the casing, the main substrate and the wireless communication module are physically protected. Further, since the casing is formed of a synthetic resin, the casing transmits the electric waves. Accordingly, a good communication is maintained.

BRIEF DESCRIPTION OF THE DRAWINGS

These and other objects and advantages of the present invention will be more fully apparent from the following detailed description taken in conjunction with the accompanying drawings, in which.

DETAILED DESCRIPTION OF THE ILLUSTRATIVE ASPECTS

Figure 1:
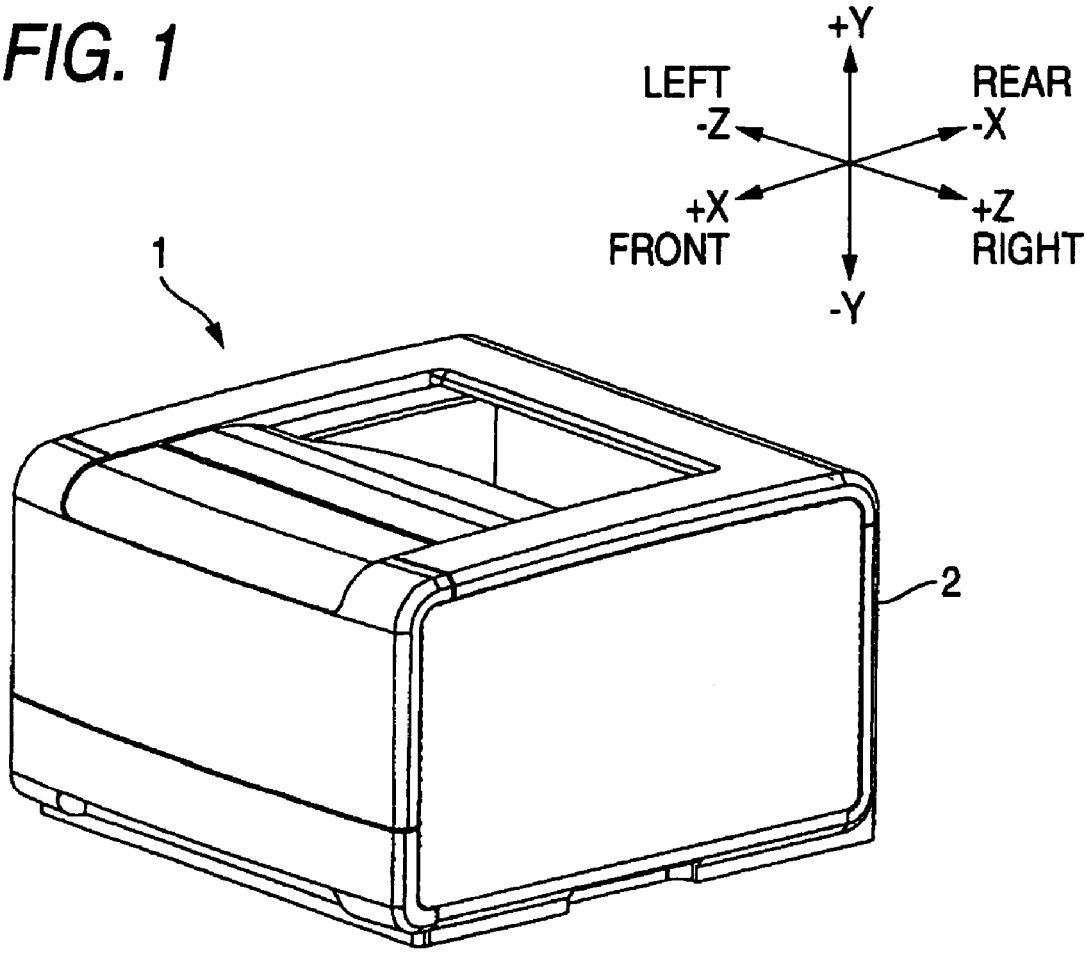
FIG. 1 is a perspective view showing a laser printer applying a printer according to the invention.

FIG. 1 is a perspective view showing a laser printer applying a printer according to the invention. A depth direction of the laser printer is an X direction (where a front is +X), a width direction is a Z direction (where a front right direction in FIG. 1 is +Z), and a height direction is a Y direction (where a top in FIG. 1 is +Y).

The laser printer 1 (a printer main body) includes a left frame 11 and a right frame 12, which support an internal mechanism, and a main body cover 2 (a casing), which covers each external side of the left and right frames 11 and 12. Specifically, the main body cover 2 covers a left side of the left frame 11, a right side of the right frame 12, a front, rear and upper side of the left and right frames 11 and 12. The main body cover 2 is attached to the left and right frames 11 and 12 by screws or the like. The left and right frames 11 and 12 are molded of a synthetic resin such as an ABS or a polycarbonate. Also, the main body cover 2 is molded of a synthetic resin such as a polystyrene or ABS.

A feeder (not shown) for feeding a sheet as a recording medium, an image forming unit 3 for forming an image on the sheet fed, a heat fusing mechanism (not shown) for fusing a toner image transferred to the sheet onto the sheet, and the like are supported between the left and right frames 11 and 12.

Figure 2:
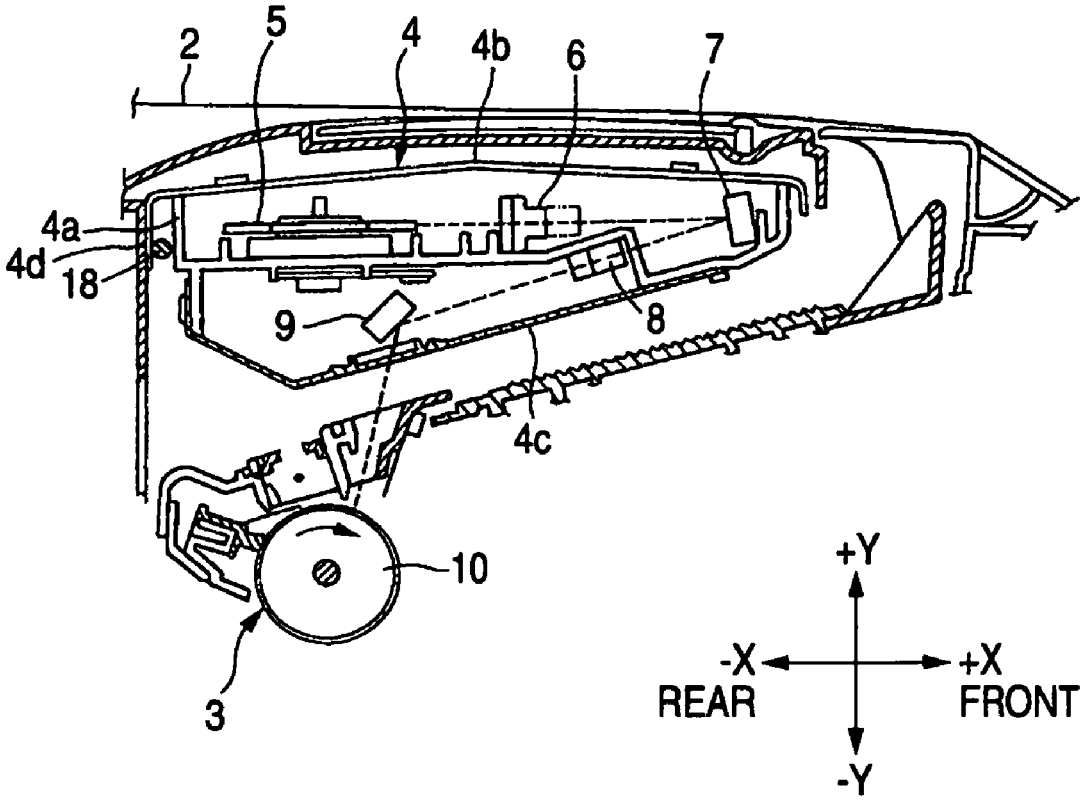
FIG. 2 is a sectional view showing a scanner of the laser printer in FIG. 1.

The image forming unit 3 includes a scanner 4 (scanner unit, which is shown in FIG. 2.

The scanner 4 is provided at an inner top of the main body cover 2, between the left and right frames 11 and 12. The scanner 4 includes a laser beam source (not shown), a rotationally driven polygon mirror 5, an fθ lens 6, a reflecting mirror 7, a lens 8 and a reflecting mirror 9. As shown by a chain line of FIG. 2, a laser beam, which is emitted from the laser source based on an image data, is deflected by the polygon mirror 5. The optical path is turned back by the reflecting mirror 7 after passing through the fθ lens 6. The optical path is further bent downwards by the reflecting mirror 9 after further passing through lens 8. The laser beam is projected onto a surface of a photosensitive drum 10 of the image forming unit 3. The polygon mirror 5, the fθ lens 6, the reflecting mirror 7, the lens 8 and the reflecting mirror 9 are attached to a casing 4*a* of the scanner 4, while the casing 4*a* of the scanner 4 is attached between the left and right frames 11 and 12.

A top surface of the casing 4*a* of the scanner 4 is covered by a metal plate 4*b* (a shielding plate member). A bottom surface of the casing 4*a* is covered by a metal plate 4*c*. A drooping portion 4*d*, which extends in a downward direction, is formed on a rear edge of the metal plate 4*b*. The drooping portion 4*d* spans a gap between the left and right frames 11 and 12 along the rear edge of the metal plate 4*b*.

Figure 3:
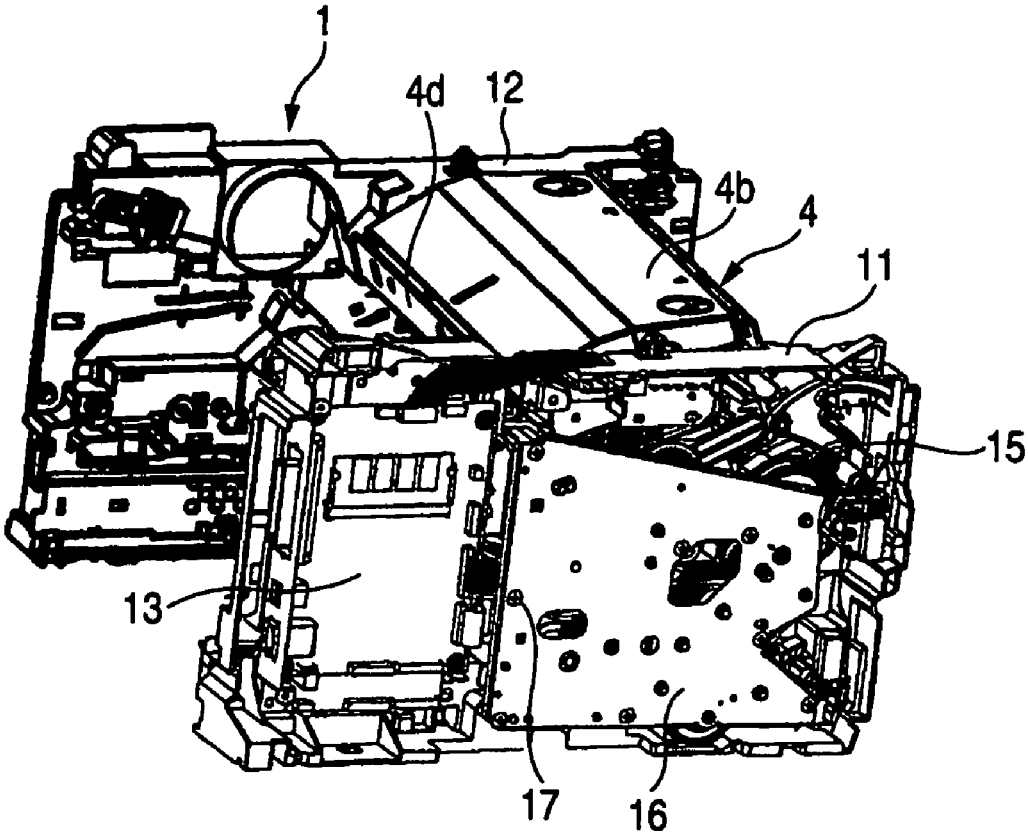
FIG. 3 is a perspective view showing a frame structure of the laser printer in FIG. 1.
Figure 3:
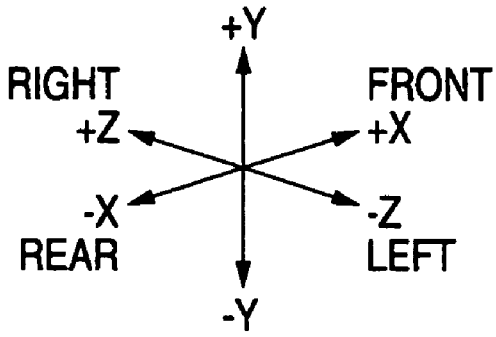
Figure 4:
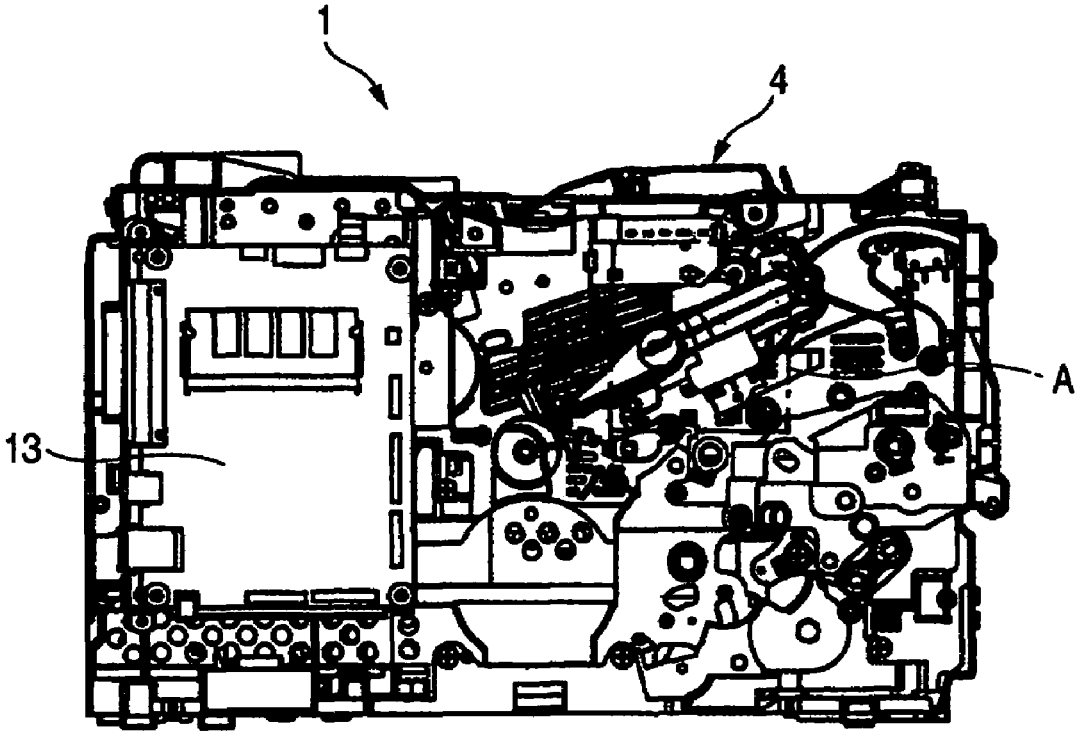
FIG. 4 is a left-side view showing the frame structure of the laser printer in FIG. 3.

As shown in FIGS. 3 and 4, a main substrate 13, mounting electronic parts for the purpose of controlling the laser printer 1, is disposed on an external surface of the left frame 11. The main substrate 13 is covered by a shielding plate. The shielding plate is formed of a metal material in order that unnecessary electric waves do not escape from the main substrate 13.

Figure 5:
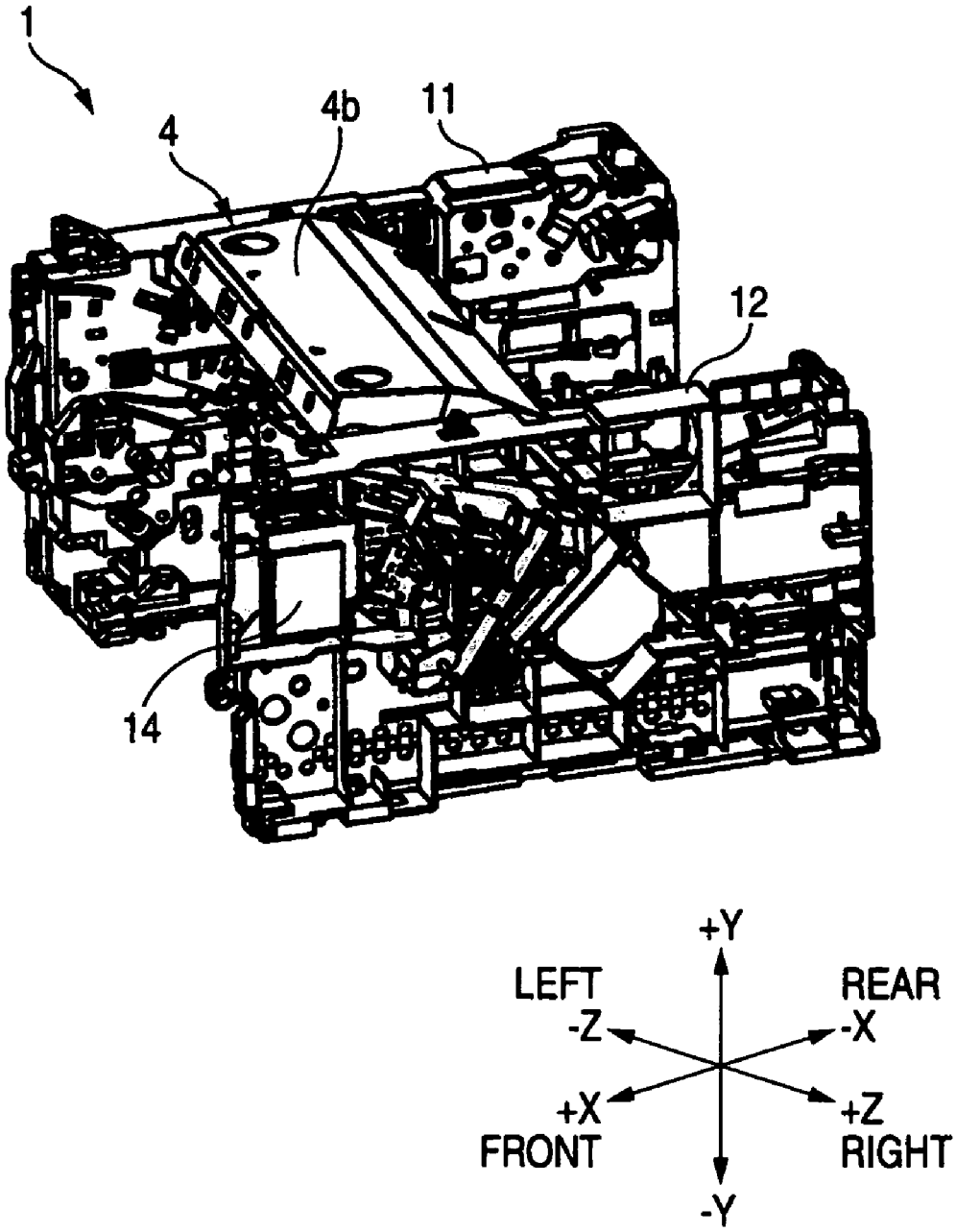
FIG. 5 is a view schematically showing the frame structure of the laser printer in FIG. 1 seen from another direction.
Figure 6:
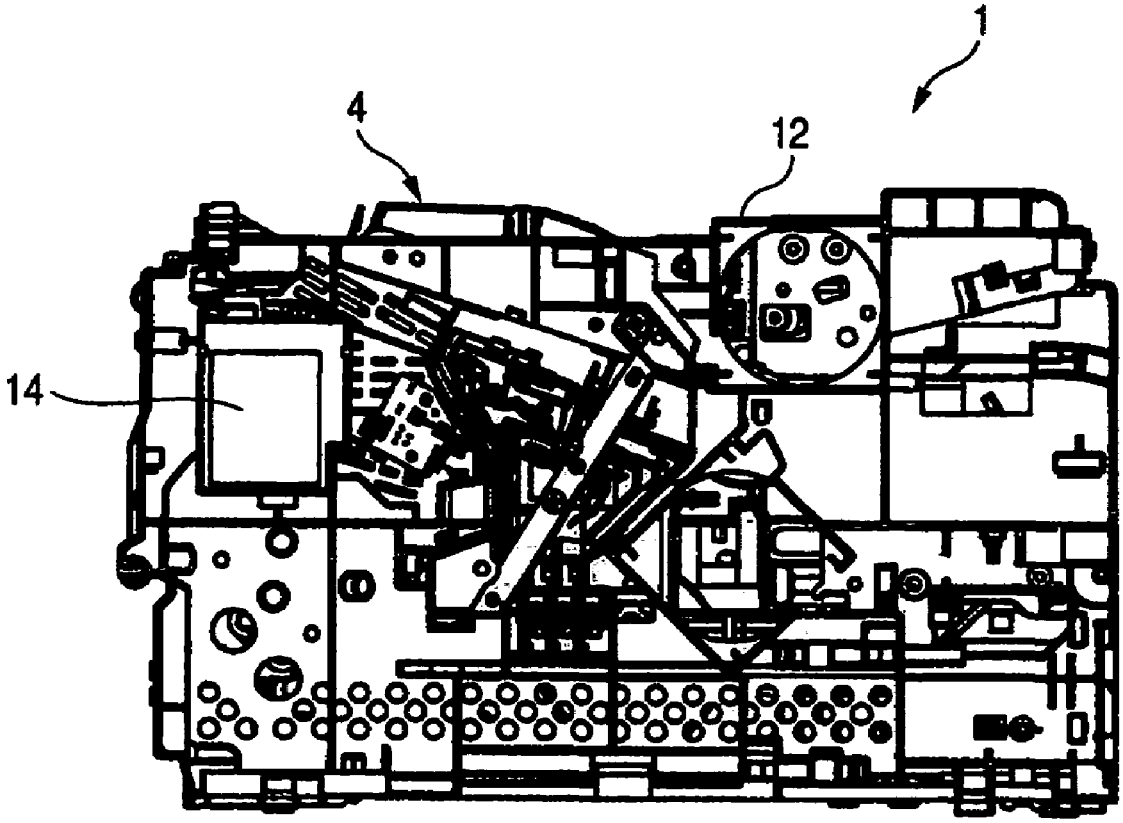
FIG. 6 is a right-side view showing a frame structure of the laser printer in FIG. 5.
Figure 7:
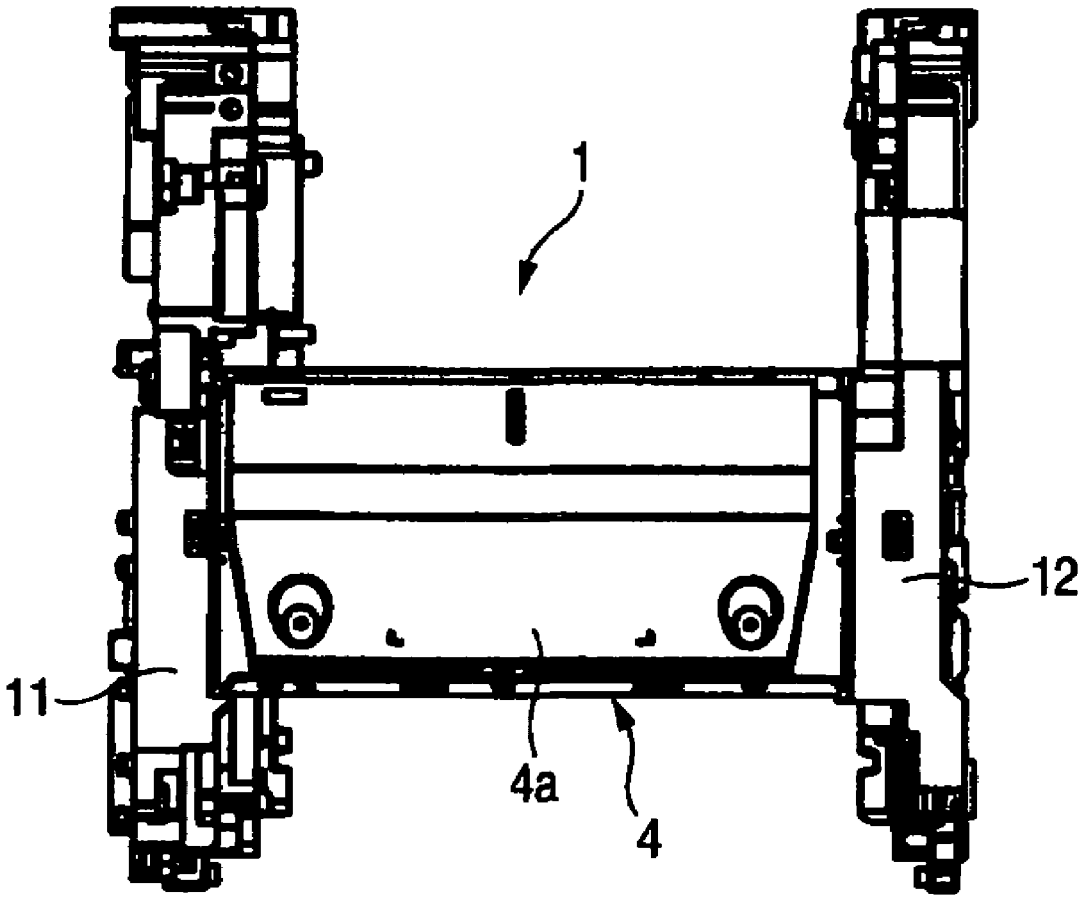
FIG. 7 is a view plane view showing the frame structure of the laser printer in FIG. 5.

Meanwhile, as shown in FIGS. 5 and 6, a wireless communication module 14 is built into an external surface of the right frame 12. The main substrate 13 and the wireless communication module 14 are disposed respectively in the left and right frames 11 and 12, and covered by the main body cover 2.

As shown in FIG. 3, a gear train 15, which rotationally drives the internal mechanism, is disposed on the external surface of the right frames 11. A metal plate 16, which rotationally supports the gear train, is attached further outside of the external surface by fastening unit 17 such as screws.

The wireless communication module 14 include a wireless communication unit and a wireless antenna. As shown in FIGS. 5 and 6, the wireless communication module 14 is disposed in a position inside the laser printer 1 diagonally opposite the main substrate 13. The wireless communication module 14 is disposed in the front of the inside of the laser printer 1, on the top right seen from the front. Also, the wireless communication module 14 is disposed parallel to the main substrate 13.

As shown in FIG. 2, the main substrate 13 is connected to the wireless communication unit of the wireless communication module 14 via a cable 18 such as a USB (Universal Serial Bus). The cable 18 is distributed along a gap between the casing 4*a* of the scanner 4 and the drooping portion 4*d* of the metal plate 4*b*. In this aspect, the main substrate 13 is disposed on the external surface of the left frame 11. The wireless communication module 14 is disposed on the external surface of the right frame 12. Therefore, although the cable 18, which connecting the main substrate 13 and the wireless communication module 14, is longer compared with a case in which the main substrate 13 and the wireless communication module 14 are disposed on the external surface of the same frame 11, the unnecessary electric waves escaping from the cable 18 are shielded by the drooping portion 4*d* of the metal plate 4*b* and prevented from being radiated to the exterior.

Figure 8:
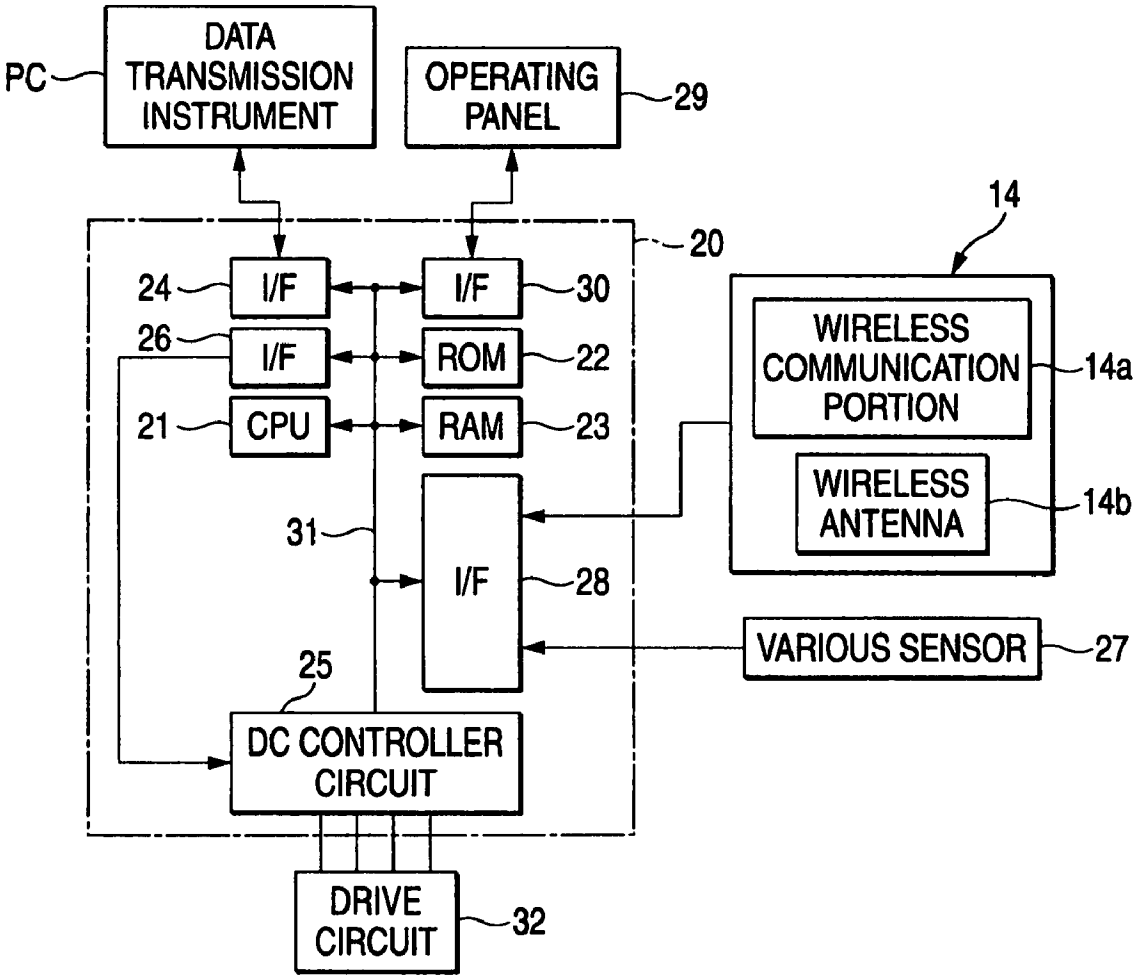
FIG. 8 is a block diagram showing a control unit of the laser printer according to an aspect.

Next, a description will be given, with reference to FIG. 8, of a control unit of the laser printer according to the aspect. FIG. 8 is a block diagram showing the control unit of the laser printer according to the aspect. A large number of the electronic parts configuring the control unit are disposed on the main substrate 13.

As shown in FIG. 8, the control unit 20 includes a CPU 21; an ROM 22, in which various control programs are stored; an RAM 23 provided with various memories such as a receive buffer, which receives and stores transmission data transmitted from an external data transmission instrument PC, such as a personal computer or a host computer; an interface (I/F) 24, which receives transmitted printing data; an interface (I/F) 26, including a scan buffer, which transmits a printing information converted into bit image data sequentially to a DC controller circuit 25; the wireless communication module 14 including, the wireless communication unit 14*a* and the wireless antenna 14*b*; an interface (I/F) 28, which receives detection signals from the wireless communication module 14 and various sensors 27; and an interface (I/F) 30, which can select various control modes from an operating panel 29 and receives a switch signal thereof. These components are all connected to the CPU 21 via a bus 31.

A drive circuit 32 drives various rollers, motors and heaters (not shown). The drive circuit 32 is connected to the DC controller circuit 25. The wireless antenna 14*b* of the wireless communication module 14 carries out a transmission and reception of printing data etc. with respect to each node configuring a wireless LAN.

Next, an operation of this aspect will be described.

Figure 9:
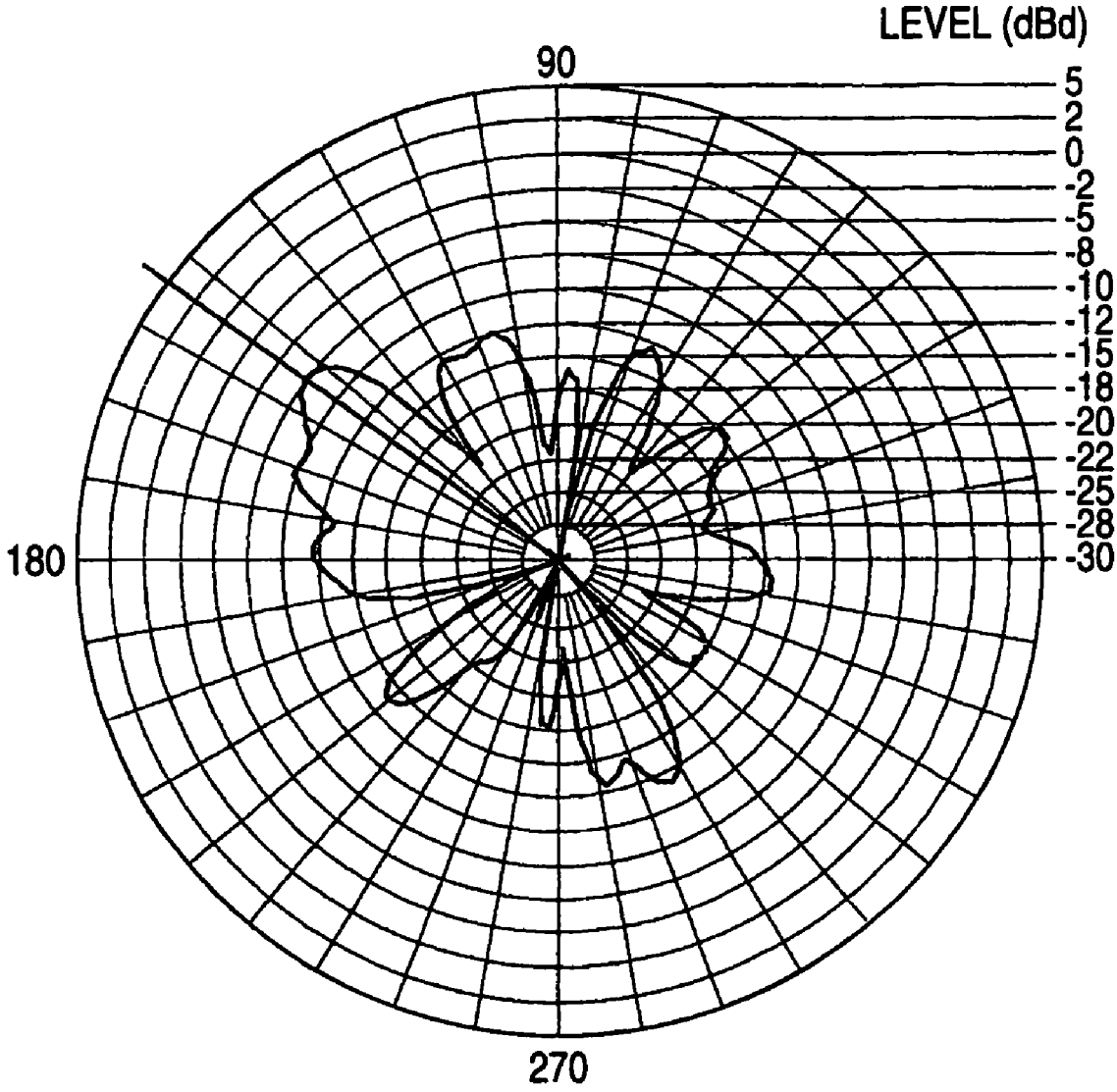
FIG. 9 is a view showing a reception pattern of a wireless antenna of a wireless communication module according to a comparative example.
Figure 10:
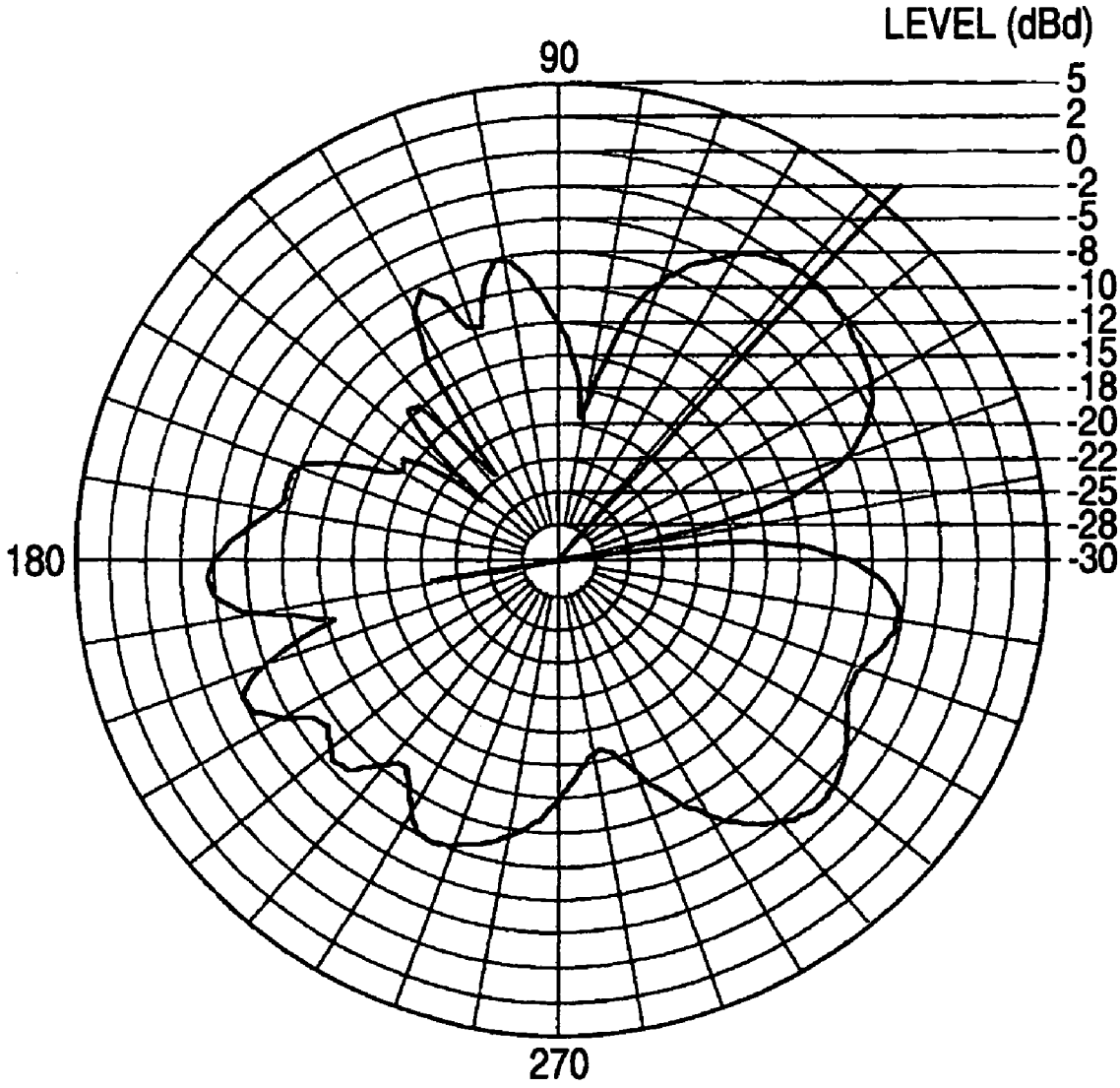
FIG. 10 is a view showing a reception pattern of the wireless antenna of the wireless communication module according to an aspect.

FIG. 9 is a view showing a reception pattern of the wireless antenna of the wireless communication module in a comparative example. FIG. 10 is a view showing a reception pattern of the wireless antenna of the wireless communication module according to this aspect.

FIG. 9 shows the reception pattern in a case in which the wireless communication module is disposed in a portion A of FIG. 4. The portion A is positioned on the upper right hand side of and spaced a distance from the main substrate 13 in the left frame 11. According to FIG. 9, since the wireless communication module is disposed in the main substrate 13 side of the left frame 11, a communication interference caused by the main substrate 13 is received, a dip is seen, and a pattern having directivity is obtained.

On the contrary, in FIG. 10, the communication module 14 is disposed on a side of the laser printer 1 different to that of the main substrate 13. The communication module 14 is disposed in a position diagonally opposite the main substrate 13. The position of the wireless communication module 14 is in an upper portion of a side in the front of the inside of the laser printer 1; wireless communication module 14 is disposed parallel to the main substrate 13. This reduces the occasions on which the main substrate 13 interferes with the communication, so that a reception sensitivity is high and there is no dip, and a reception pattern having almost no directivity is obtained.

According to the aspects, since the wireless communication module 14 is built into the laser printer 1, a connecting of a wireless communication apparatus and a printer is eliminated. Accordingly, the printer can be used easily. Further, according to the aspect, the main substrate 13 is disposed in one side surface of the laser printer 1. The wireless communication module 14 is disposed in the other side surface of the laser printer 1. Thus, the wireless communication module 14 is separated from the main substrate 13. Accordingly, the main substrate 13 does not become an obstacle to the communication, and, a good communication is maintained.

Also, according to the aspects, the wireless communication module 14 is disposed in a position inside the laser printer 1 diagonally opposite the main substrate 13. It thereby follows that the wireless communication module 14 is further separated from the main substrate 13. Therefore, it is possible to further reduce the occasions on which the main substrate 13 interferes with the communication.

Furthermore, according to the aspects, the position of the wireless communication module 14, which is diagonally opposite the main substrate 13, is in an upper portion of a side in the front of the inside of the laser printer 1. This prevents the electric waves from being blocked by an impediment, thus enabling the carrying out of good communication.

According to the aspects, the wireless communication module 14 is disposed parallel to the main substrate 13. It thereby follows that the wireless communication module 14 is further separated from the main substrate 13. Therefore, it is possible to further reduce the occasions on which the main substrate 13 interferes with the communication.

Also, according to the aspects, the wireless communication module 14 includes the wireless communication unit 14*a* and the wireless antenna 14*b*. This makes it possible to carry out good communication.

According to the aspects, the cable 18, which connects the wireless communication unit 14*a* and the main substrate 13, is distributed along the casing 4*a* of the scanner 4 of the laser printer 1. Therefore, a wiring pathway is reliably formed, thus enabling the carrying out of stable communication.

Further, according to the aspects, the cover which covers the top surface of the casing 4*a* of the scanner 4 is configured of the metal plate 4*b* for shielding, and the cable 18 is distributed along the drooping portion 4*d* of the shielding metal plate 4*b*. Therefore, it is possible to increase a shielding effect with respect to the unnecessary electric waves emitted from the cable 18.

Also, according to the aspects, the main substrate 13, mounting electronic parts for the purpose of controlling the laser printer 1, is disposed on the external surface of the frame 11, which is one of the synthetic resin left and right frames. The wireless communication module 14 is disposed on the external surface of the frame 12, which is the other of the synthetic resin left and right frames. Therefore, the wireless communication module 14 is separated from the main substrate 13. Thus, the main substrate 13 does not become an obstacle to the communication. Further, according to the aspects, as the main substrate 13 and the wireless communication module 14 are covered by the main body cover 2, the main substrate 13 and the wireless communication module 14 are physically protected. Further, since the main body cover 2 is formed of a synthetic resin, the casing transmits the electric waves. Accordingly, a good communication is maintained.

Furthermore, according to the aspects, the gear train, which rotationally drives the internal mechanism, and the metal plate 16, which rotationally supports the gear train 15, are disposed on the external surface of the one frame 11. Therefore, the external surface of the frame 11 is covered by the metal plate 16, thus making it possible to avert an electric wave interference.

Then, according to the aspects, the casing 4*a* of the scanner 4 is disposed between the left and right frames 11 and 12, and the cable 18, which connects the wireless communication unit 14*a* and the main substrate 13, is distributed along the casing 4*a* of the scanner 4. Therefore, it is possible to reliably form a connection pathway of the cable 18.

According to the aspects, a description has been given of an example of the invention applied to a laser printer. However, the invention can also be applied to an ink jet printer or the like, as long as it is a printer including a wireless communication module.

Also, according to the aspects, the cover, which covers the top surface of the casing 4*a* of the scanner 4, is configured of a shielding metal plate member. However, it is also acceptable that the whole casing 4*a* is configured of the shielding metal plate member, that is, it is sufficient that at least one portion of the casing 4*a* is configured of the shielding metal plate member.

What is claimed is:

1. A printer comprising:

an image forming unit that is configured to form an image on a recording medium;

a first frame that includes a first surface facing the image forming unit and a second surface facing opposite to the image forming unit;

a second frame that includes a first surface facing the image forming unit and a second surface facing opposite to the image forming unit;

a gear train that is configured to drive the image forming unit, the gear train disposed on the second surface of the first frame;

a main substrate that includes electronic parts configured to control the image forming unit; and a wireless communication module that is configured to transmit and receive data;

wherein the image forming unit is disposed between the first surface of the first frame and the first surface of the second frame;

wherein the main substrate is disposed on the second surface of the first frame; and wherein the wireless communication module is disposed on the second surface of the second frame.

2. The printer according to claim 1, wherein the wireless communication module is disposed on the second surface of the second frame in a position which is diagonally across the image forming unit from the main substrate that is disposed on the second surface of the first frame.

3. The printer according to claim 2, wherein the main substrate and the wireless communication module are disposed such that a distance between the main substrate and the wireless communication module within the printer is maximized.

4. The printer according to claim 1, wherein:

the wireless communication module includes a wireless communication substrate; and the wireless communication substrate is disposed parallel to the main substrate.

5. The printer according to claim 4, wherein the wireless communication substrate includes a wireless communication unit and a wireless antenna.

6. The printer according to claim 1, wherein the image forming unit comprises:

a scanner unit that emits a laser beam; and a scanner unit casing in which the scanner unit is disposed; and the printer further comprises a cable, which connects the wireless communication module and the main substrate, wherein the cable is routed between the wireless communication module and the main substrate along the scanner unit casing.

7. The printer according to claim 6, wherein:

at least one portion of the scanner unit casing is formed of a metal plate member for shielding; and the cable is routed along the portion formed of the metal plate member.

8. The printer according to claim 1, wherein the main substrate is disposed on a first side of the printer, and the wireless communication module is disposed on a second side of the printer across the image forming unit from the first side of the printer.

9. The printer according to claim 1, wherein the wireless communication module is disposed in a position which is diagonally across from a position in which the main substrate is disposed when viewed from above of the printer.

* * * * *